United States Patent [19]

Koiwa et al.

[11] 4,030,196

[45] June 21, 1977

[54] HAIR CUTTER

[76] Inventors: Seki Koiwa, No. 2-4-13, Nakamura, Nerima, Tokyo; Hajime Hasegawa, No. 3-21-13, Miyasaka, Setagaya, Tokyo, both of Japan

[22] Filed: Jan. 27, 1976

[21] Appl. No.: 652,791

[30] Foreign Application Priority Data

Jan. 29, 1975 Japan ..... 50-11373

[52] U.S. Cl. ..... 30/133; 30/30

[51] Int. Cl.[2] ..... B26B 19/20; B26B 19/44

[58] Field of Search ..... 30/133, 201, 30, 31

[56] References Cited

UNITED STATES PATENTS

| | | | |
|---|---|---|---|
| 1,404,798 | 1/1922 | Severson | 30/133 X |
| 1,423,363 | 7/1922 | Severson | 30/133 X |
| 3,353,265 | 11/1967 | Mendoza | 30/133 |

*Primary Examiner*—Al Lawrence Smith
*Assistant Examiner*—J. C. Peters
*Attorney, Agent, or Firm*—Young & Thompson

[57] ABSTRACT

A hair cutting device which comprises a casing opened at its one side for suction of the hair ends and communicated at its another place with a delivery passage connectable to a collection means and a cutting edge combined with a comb and arranged movably against an opened end of the casing is disclosed.

3 Claims, 9 Drawing Figures

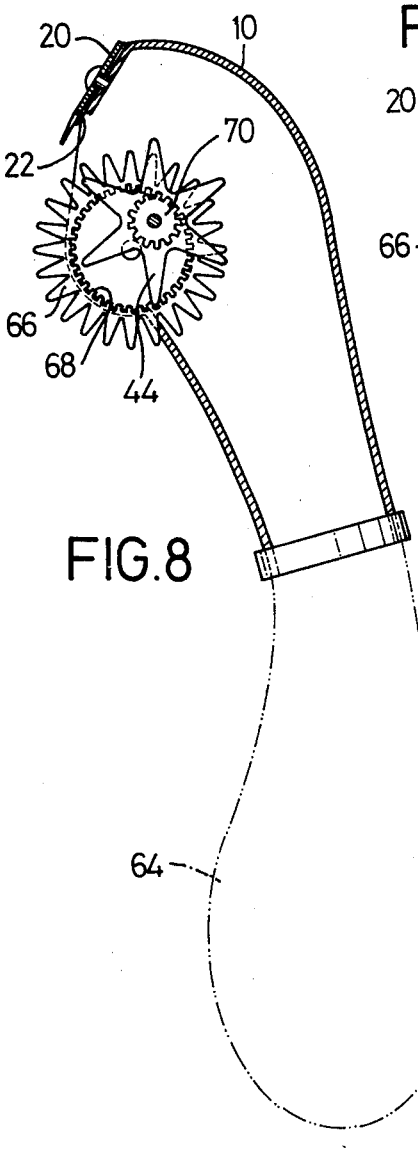
FIG.8
FIG.9
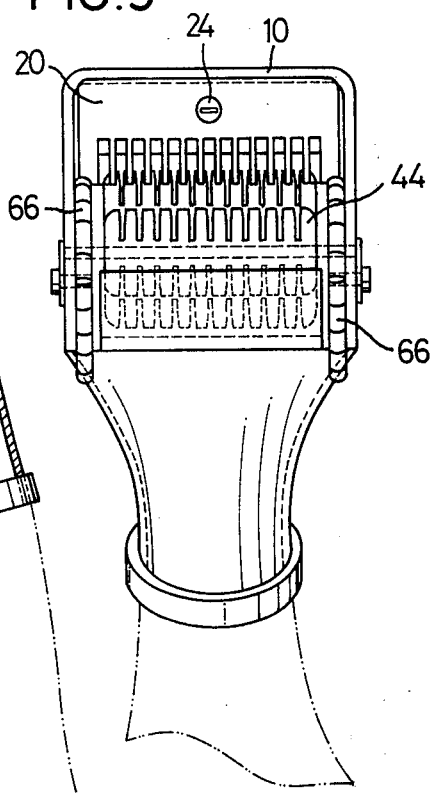

HAIR CUTTER

This invention relates to an improved hair cutter and more particularly to a hair cutter which performs a perfect collection of hair chips and dusts such as dandruff.

Heretofore, many types of hair cutters have been proposed for practical use, notwithstanding neither type of them has settled a problem of collecting hair chips.

It is, therefore, a general object of the invention to provide a hair cutter which performs a perfect collection of hair chips and other dusts with a smooth hair cutting operation.

In accordance with the present invention, the hair cutter is comprised of a casing opened at its one side for suction of hair ends and communicated at its another place with a delivery passage connectable to a suitable collection means such as a conventional vacuum cleaner for example. In the casing a cutting edge combined with a guide comb is movably arranged so that a distance or an angle of the cutting edge against the opened end of the casing is selectively changed for adjusting a cut length of the hair. When the hair cutter thus constructed is connected to the known vacuum cleaner and the opened end of the casing is approached to the hair, the hair ends are sucked into the casing under the turbulent air flow generated in the casing and cut in collision with the cutting edge. The hair chips produced are passed into the collection means as hereinafter fully described.

The principal object of the present invention is to provide a hair cutting device which comprises a casing opened at its one side for suction of the hair ends and communicated at its another place with a delivery passage connectable to a collection means and a cutting edge combined with a comb and arranged movably against an opened end of the casing.

In lieu of connecting hair cutter in accordance with the present invention to the conventional vacuum cleaner as hereinbefore described, a rotary comb fan may be provided in the casing in relation to be cutting edge to generate a negative pressure in the casing while simultaneously combing up the hair ends with the fan blades on rotation against the cutting edge. The hair chips are guided into the collection means such as a dust bag communicated to the cutter casing. The comb fan may be drive manually or mechanically as hereinafter fully described.

A further object of the invention is, therefore, to provide a hair cutter which comprises a casing opened at its one side and communicated at its another place with a delivery passage connectable with a hair chip collecting means, a cutting edge combined with a comb and arranged movably against an open end of the casing and a comb fan which is turnably arranged in relation to the cutting edge to generate a negative pressure in the casing while simultaneously combing up the hair ends against the cutting edge.

Other objects and advantages of the present invention will become apparent as the detailed description thereof proceeds.

For a fuller understanding of the present invention reference should now be had to the following detailed description thereof taken in conjunction with the accompanying drawings in which:

FIG. 8 is a longitudinally sectioned view of the hair cutter of an additional embodiment of the invention wherein a rotary comb fan with guide geared wheels are provided; and FIG. 9 is a front elevation of the hair cutter of FIG. 8.

Figure 1:
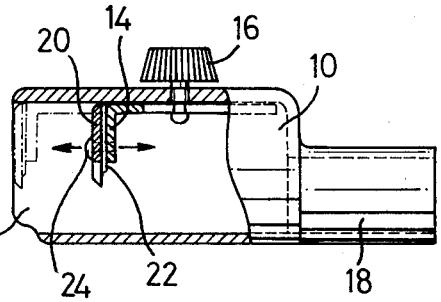
FIG. 1 is a lateral view in partially sectioned of the hair cutter according to the present invention.
Figure 2:
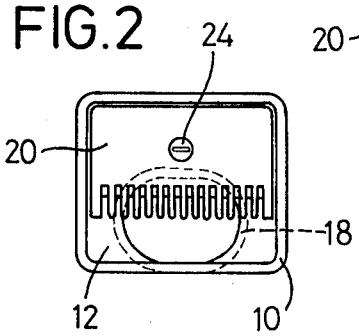
FIG. 2 is a front elevation of the hair cutter of FIG. 1.

In FIG. 1 and 2, the hair cutter in accordance with the present invention comprises a casing 10 which at its one side is opened to provide a port 12 with an edge support member 14 of substantially L shape which is slidably mounted to the casing 10 through a set screw 16. The casing 10 is communicated at its opposite side with a delivery passage 18 which may be selectively connected to the conventional dust collection apparatus such as a vacuum cleaner for domestic use. On the end of the edge supporting member 14 are attached a guide comb 20 and a cutting edge 22 through a screw 24. The terminal of the bottom plate of the casing 10 is preferably somewhat retracted from the open end of the casing 10 to relieve the suction of the port of the casing 10 against the human skin on use of the cutter.

Figure 3:
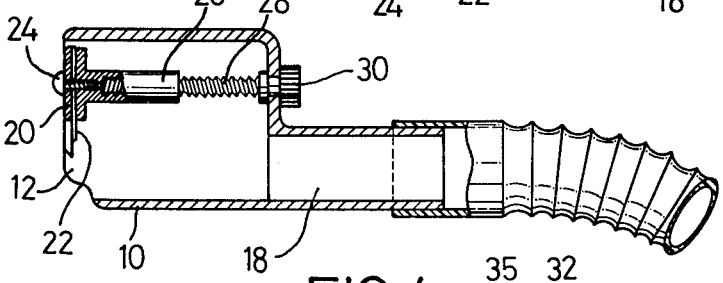
FIG. 3 is a longitudinally sectioned view of the hair cutter of another embodiment of the invention.

In FIG. 3, the edge supporting member 14 is secured to a female screw 26 which is coupled with a male screw 28 having at its one end a knob 30. It will be appreciated that the guide comb 20 with the cutting edge 22 may be selectively retracted or advanced by manually turning the knob 30 to adjust the cut length of the hair.

Figure 4:
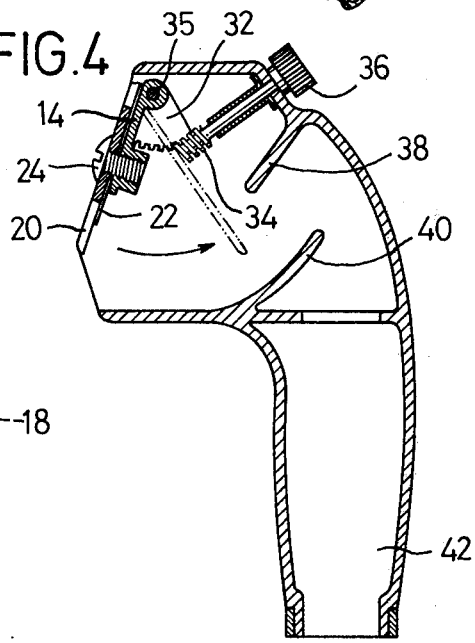
FIG. 4 is a longitudinally sectioned view of the hair cutter of a further embodiment of the invention.

In FIG. 4, the edge supporting member 14 is secured to a sector gear 32 which is pivoted to a pin 34 in mesh with a warm 34 connected to an operation knob 36. It will also be appreciated that the cutting edge 22 with the guide comb 20 is turned about the pin 35 when the warm 34 in mesh with sector gear 32 is manually operated. The guide members 38 and 40 form a path for smooth air flow into the collecting section 42.

Figure 5:
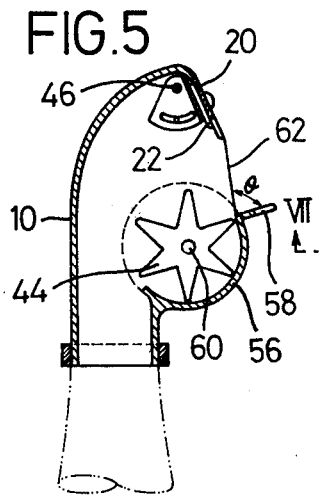
FIG. 5 is a longitudinally sectioned view of the hair cutter of a furthermore embodiment of the invention wherein a rotary comb fan is provided.
Figure 6:
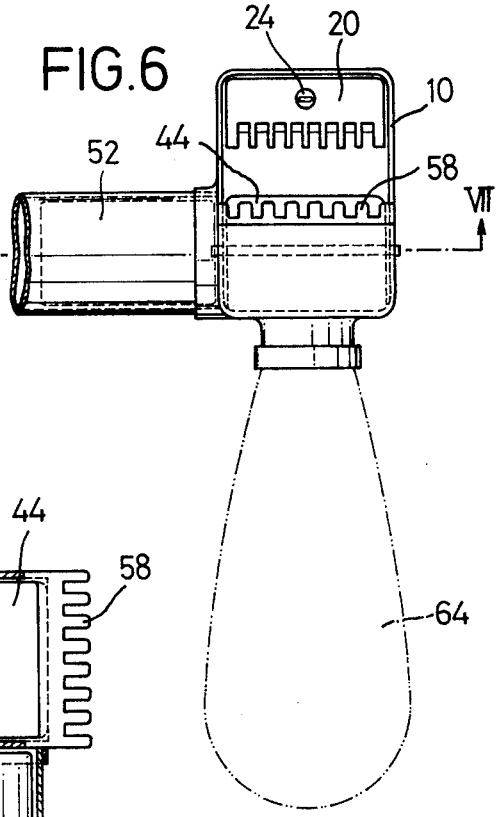
FIG. 6 is a front elevation of the hair cutter of FIG. 5.
Figure 7:
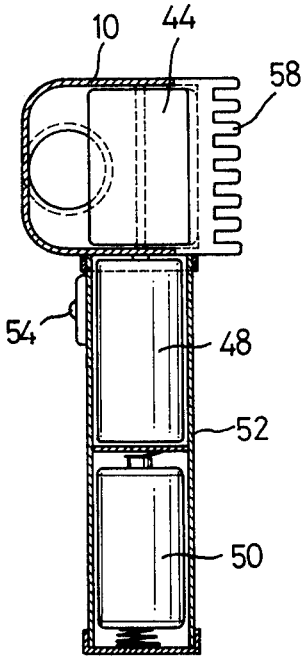
FIG. 7 is a sectional view taken along the line VII-VII of FIG. 6.

The hair cutter embodied in FIG. 5 to 7 is a portable or handy type in which a rotary comb fan 44 is arranged in relation to a cutting edge 22 which is turnable about the pin 46. The rotary comb fan 44 is driven by an electric motor 48 energized by a battery 50 both housed in a grip casing 52. The reference numeral 54 is a switch for the motor 48.

The rotary comb fan 44 is partially protected by a cover 56 having at its one terminal a bracket comb 58 and turnable about an axis 60 of the fan to change an angle 0 of the bracket comb 58 against the port 62. the cutter casing 10 is also communicated with a hair chip collecting bag 64.

In the embodiment as illustrated in FIG. 8 and 9, the comb fan 44 is driven by means of the geared wheels 66, 66 symmetrically arranged on opposite sides of the comb fan 44 through a gear 68 and a pinion 70. It will be appreciated that when the wheels 66, 66 run on the human skin, the turning rate of the comb fan 44 is increased by virtue of the gear 68 and pinion 70 to generate a negative air pressure in the casing 10 while combing up the hair ends with the fan blade against the edge 22 for cutting. The hair chips are collected in the collecting bag 64.

As hereinbefore described, in accordance with the invented hair cutter the hair shaking under the turbulent air flow is cut in collision with the edge in the casing and the hair chips are perfectly collected in the collecting means without requiring any additional operation.

While certain preferred embodiments of the invention has been illustrated by way of example in the drawings and particularly described, it will be understood that various modifications may be made in the structure and arrangements and that the invention is no way limited to the embodiments shown.

We claim:

1. A hair cutting device which comprises a casing open at one side for suction of the hair ends and communicating at another location spaced from said open side with a delivery passage connectible to suction means, a guide comb extending transversely to the sides of said casing which border said open side, a fixed cutting blade secured to the side of said comb which is opposite said open side, an L-shaped member having one leg secured against the side of said blade opposite said comb and another leg is slidable engagement with one of said casing sides, and means for selectively clamping said another leg against said one casing side.

2. A hair cutting device as claimed in claim 1, said clamping means comprising a set screw that extends through said one casing side and through an elongated slot in said another leg whereby upon tightening of said set screw, said another leg is clamped against said one casing side.

3. A hair cutting device which comprises a casing open at one end for suction of the hair ends and communicating at another location spaced from said open end with a delivery passage connectible to suction means, a guide comb extending transversely to the sides of said casing which border said open end, a fixed cutting blade secured to the side of said comb which is opposite said open end, said blade extending toward but terminating short of one of said casing sides, the edge of said blade being parallel to and spaced from said one casing side, only said one casing side being cut away to relieve suction between said device and the skin of the user.

* * * * *